United States Patent [19]

Rybak

[11] Patent Number: 5,020,452

[45] Date of Patent: Jun. 4, 1991

[54] THERMAL REMEDIATION APPARATUS AND METHOD

[75] Inventor: David T. Rybak, Fridley, Minn.

[73] Assignee: Murya, Inc., New Brighton, Minn.

[21] Appl. No.: 419,894

[22] Filed: Oct. 11, 1989

[51] Int. Cl.[5] ..... F23D 11/00

[52] U.S. Cl. ..... 110/241; 110/258; 110/236; 110/346

[58] Field of Search ..... 110/241, 258, 259, 203, 110/215, 236, 346, 244, 246, 276

[56] References Cited

U.S. PATENT DOCUMENTS

| | | | |
|---|---|---|---|
| 3,762,858 | 10/1973 | Torrence | 432/72 |
| 3,776,153 | 12/1973 | Stewart | 110/203 |
| 3,938,450 | 2/1976 | Jaronko et al. | 110/241 |
| 3,962,044 | 6/1976 | MacKenzie | 110/203 |
| 4,141,373 | 2/1979 | Kartanson et al. | 134/21 |
| 4,419,942 | 12/1983 | Johnson | 110/203 |
| 4,420,901 | 12/1983 | Clarke | 47/1.44 |
| 4,487,139 | 12/1984 | Warner | 110/345 |
| 4,557,202 | 12/1985 | Warner | 110/216 |
| 4,648,332 | 3/1987 | Goedhart | 110/346 |
| 4,667,609 | 5/1987 | Hardison et al. | 110/236 |
| 4,688,494 | 8/1987 | Domwitch | 110/241 |
| 4,700,638 | 10/1987 | Przewalski | 110/346 |
| 4,730,564 | 3/1988 | Abboud | 110/241 |
| 4,782,625 | 11/1988 | Gerken et al. | 47/1.42 |
| 4,815,398 | 3/1989 | Keeting, II et al. | 110/233 |

OTHER PUBLICATIONS

Honeywell, Inc., Minneapolis, Minn.: A product manual for the S87 series.

*Primary Examiner*—Edward G. Favors
*Assistant Examiner*—Denise L. F. Gromada
*Attorney, Agent, or Firm*—Merchant, Gould, Smith, Edell, Welter & Schmidt

[57] ABSTRACT

A thermal remediation apparatus for the combustion of hydrocarbon contaminants within particulate fill including a generally cylindrical combustion chamber having an exhaust port, an inlet, an outlet, and a mill having two shafts and four burners. The apparatus also includes a condenser including a condensing unit and a conduit, and an exhaust system including a fan, and optionally an exhaust stack, and a plate burner.

41 Claims, 4 Drawing Sheets

FIG.6
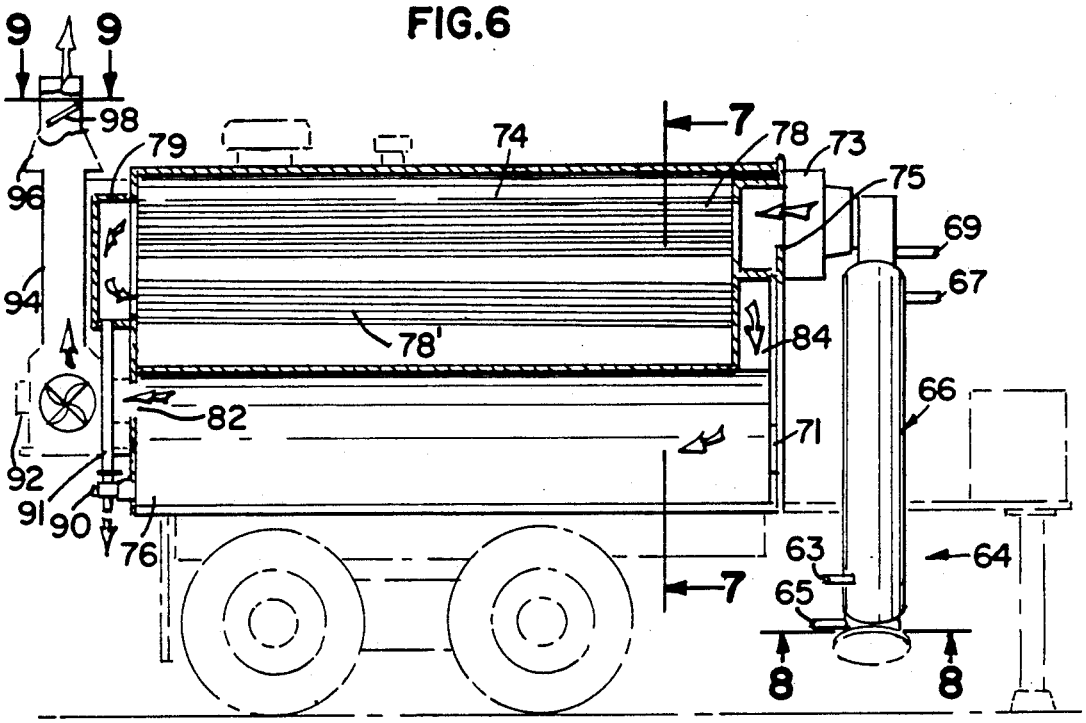
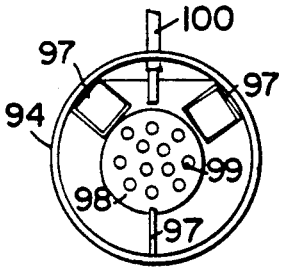
FIG. 9
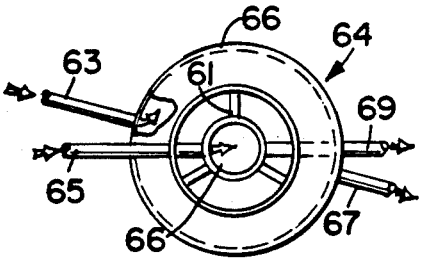
FIG.8
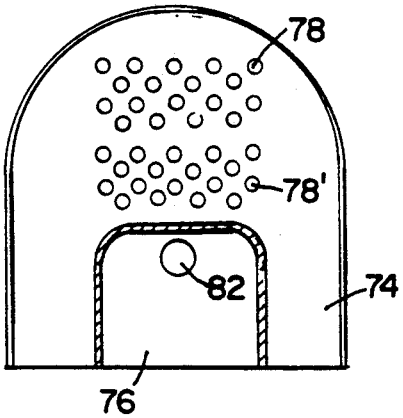
FIG.7

THERMAL REMEDIATION APPARATUS AND METHOD

FIELD OF THE INVENTION

The present invention relates generally to thermal processes for decontaminating particulate matter. More specifically, the present invention relates to a closed system for thermally remediating soil or other particulate matter.

BACKGROUND OF THE INVENTION

The overall concern for the quality of the environment has raised renewed interest in the manner in which various chemicals are synthesized, refined, stored, and used. Specifically, there is a growing concern regarding the manufacture, storage and use of fossil fuels, principally hydrocarbon fuels at the refinery, during wholesale storage and distribution, as well as during retail storage and sale.

For example, hydrocarbon fuels such as gasoline and household fuel oil are often stored in tanks which are buried at central distribution points or at retail service stations. During storage, transport and sale of these materials tank leaking or spilling often occurs, creating an area of environmental contamination which may ultimately prove hazardous.

One common means of alleviating the environmental hazard is removing and disposing of this contaminated soil in a landfill. However, landfill disposal of this contaminated matter may often be a time consuming and expensive endeavor as well as being subject to burdensome government regulations.

Contaminated soil may also be treated to remove the hydrocarbon waste through various means. Processes for the thermal remediation of contaminated soil have been developed and refined. For example, Clarke, U.S. Pat. No. 4,420,901 discloses a tractor drawn farm implement for decontaminating fields. Goedhart, U.S. Pat. No. 4,648,332 discloses a fluidized bed furnace for decontaminating soil. Przewalski, U.S. Pat. No. 4,700,638 discloses an apparatus for the disposal of hazardous material such as dioxin and polychlorinated biphenols through a thermal process. Keating II et al, U.S. Pat. No. 4,815,398 discloses a rotary dryer for thermally decontaminating soils. Gerken et al, U.S. Pat. No. 4,782,625 discloses a materials dryer used to decontaminate soils. Finally, Hardison et al, U.S. Pat. No. 4,667,609 discloses an infrared apparatus for thermally decontaminating soils. Other methods of treatment include processing soil in converted stationary asphalt plants. However, these processes are not portable and generally produce a high concentration of particulate exhaust.

However, the apparatus and methods disclosed in these patents generally utilize expensive and sophisticated machinery to dispose of contaminants such as dioxin and polychlorinated biphenols. Moreover, these mechanisms use high volumes of air, which necessitates a variety of complex exhaust filtering and cleaning systems. Finally, the previously disclosed devices and processes generally are either completely stationary or, alternatively, are portable but require the expenditure of extended time, energy, and space in transport and set up.

Accordingly, there is a need for a portable thermal remediation apparatus which is capable of removing contaminants from soil and other particulate compositions which does not require complex exhaust treatment systems, and which may be used at the contamination site with a minimum expenditure of space, set-up time, and energy.

SUMMARY OF THE INVENTION

In accordance with the present invention, there is provided a method and apparatus for thermally remediating contaminated particulate fill. The thermal remediation apparatus includes a combustion chamber having a series of burners and a mill having a plurality of shafts and mixing paddles, a condenser affixed to the combustion chamber, and a fan affixed adjacent an outlet opening at the base of the condenser. Optionally, the apparatus of the present invention may also comprise various means for loading the contaminated fill into the combustion chamber, an exhaust stack, and a profile plate burner on the stack.

The present invention thermally remediates or decontaminates contaminated particulate fill such as dirt, sand, gravel, or any other noncombustible fill material which may contain fossil or hydrocarbon fuels. The present invention efficiently combusts hydrocarbons by suspending the particulate fill within a closed chamber and then directly exposing the suspended contaminated fill to a flame which is directed to the chamber area in which the suspended fill is most concentrated. The exhaust resulting from combustion is treated simply and efficiently to remove pollutants present after processing.

Additionally, the apparatus is portable and compact allowing easy transport and set up in a minimal area and time. The apparatus may also be operated by only one person and has a construction which allows the system chamber to be easily opened providing easy access for cleaning, or any other reason. Other advantages and features of the apparatus of the present invention will become obvious with the further disclosure provided herein.

BRIEF DESCRIPTION OF THE DRAWINGS

FIG. 6 is a cut away side view of the condensing system and exhaust system of the present invention shown in FIG. 3.

FIG. 7 is a cross-sectional view taken along lines 7—7 of the condensing system of the present invention shown in FIG. 6.

FIG. 8 is a cross-sectional view taken along lines 8—8 of the precooling conduit in accordance with one embodiment of the present invention shown in FIG. 6.

FIG. 9 is a cross-sectional view taken along lines 9—9 of the exhaust stack and plate burner in accordance with one embodiment of the present invention shown in FIG. 6.

DETAILED DESCRIPTION OF THE PREFERRED EMBODIMENTS

Figure 1:
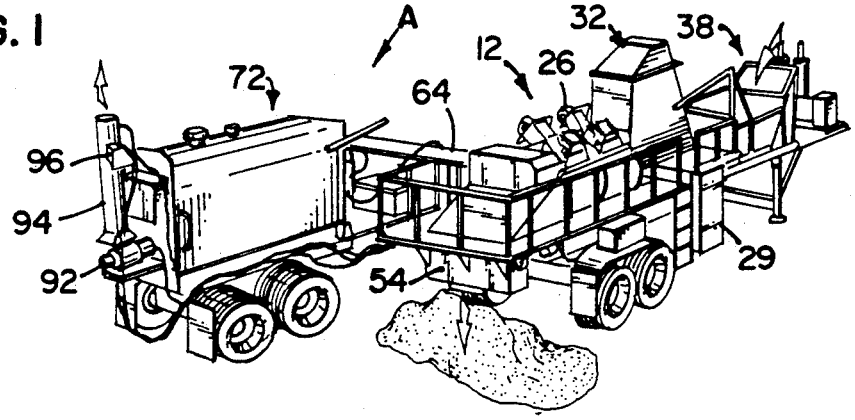
FIG. 1 is a perspective view depicting the combustion unit and condenser in accordance with one embodiment of the present invention.

Referring to the Drawings wherein like numerals represent like parts throughout several views, there is generally shown a portable thermal remediation apparatus (A) for the combustion of hydrocarbon contaminants within particulate fill in FIG. 1.

The apparatus generally comprises a cylindrical combustion chamber 12 having a front end 14 and rear end 16 with an inlet 11 at the front end and an outlet 13 at the rear end. The combustion chamber has a removable top 15, FIG. 5, which is fitted to expand during the thermal processing and can be removed for immediate access to the combustion chamber if the need for maintenance arises. Inside the combustion chamber, FIGS. 4 and 7, a mill traverses the length of the combustion chamber. The mill 20 has two shafts, 22*a* and 22*b* with a plurality of mixing paddles 24 positioned on them.

Also housed within the combustion chamber 12 are burners 26 offset across the upper exterior surface 13 of the combustion chamber 12. The burners 26 are positioned to direct flames towards the mill shafts 22*a* and 22*b*. The thermal remediation apparatus may also include a discharge hopper 52 positioned adjacent the rear opening 13 of the combustion chamber. The exhaust hopper 52 may additionally include a sealing mechanism 54 such as air powered clam shell-type doors.

Figure 2:
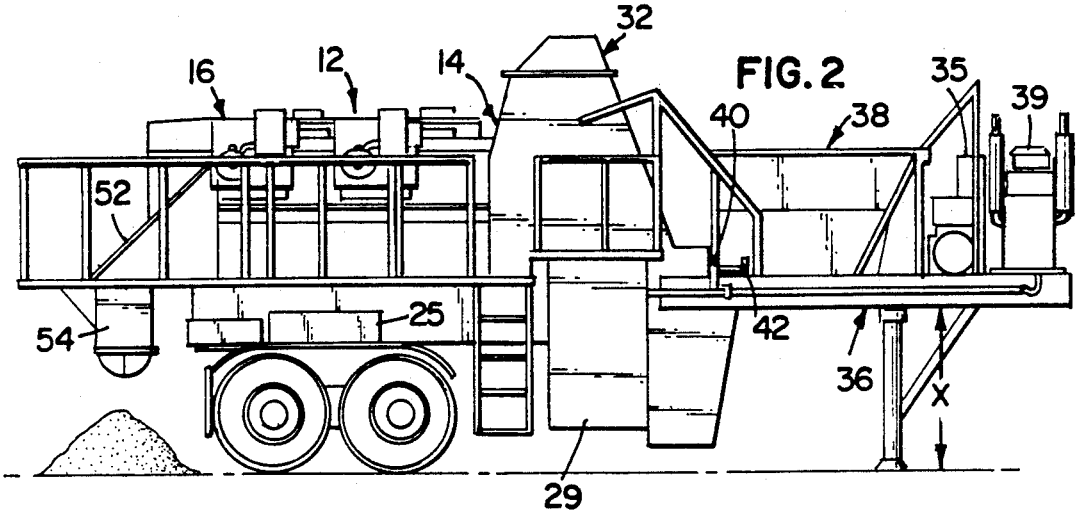
FIG. 2 is a side view depicting the combustion unit, loading means, and control means in accordance with one embodiment of the present invention.
Figure 4:
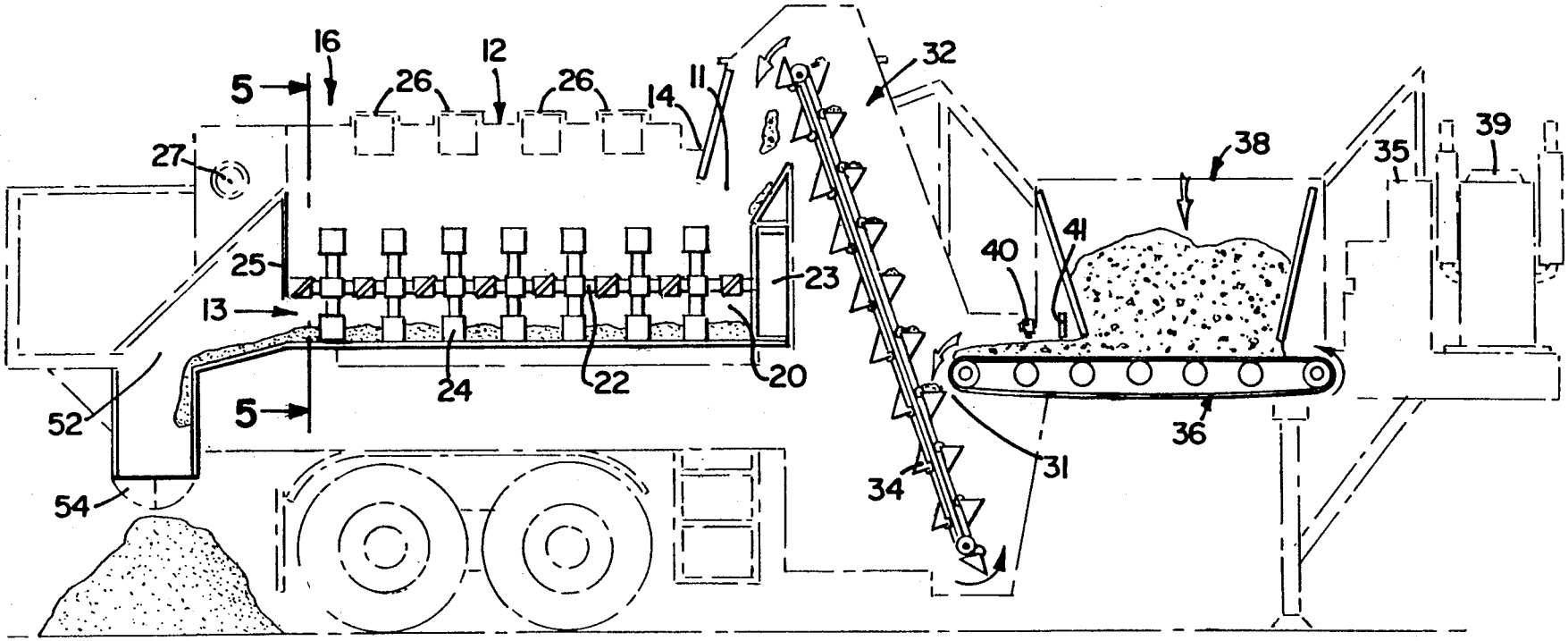
FIG. 4 is a cut away side view of the combustion chamber and loading means of the present invention shown in FIG. 2.

The thermal remediation apparatus may optionally include any variety of means for loading contaminated fill into the combustion chamber 12. For instance, as seen in FIGS. 2 and 4, the loading means are positioned adjacent the combustion chamber front end 14 and may include the bucket elevator 32, a feed belt 36, and a hopper 38. Optionally a spray bar 40 having a number of spray ports over the length of the bar 40 may also be positioned above the feed belt 36. Also a feeder plate 41 for controlling the volume of fill introduced into the bucket elevator 32 may be positioned over the width of feed belt 36 and adjacent the hopper 38 and before the spray bar 40.

Figure 3:
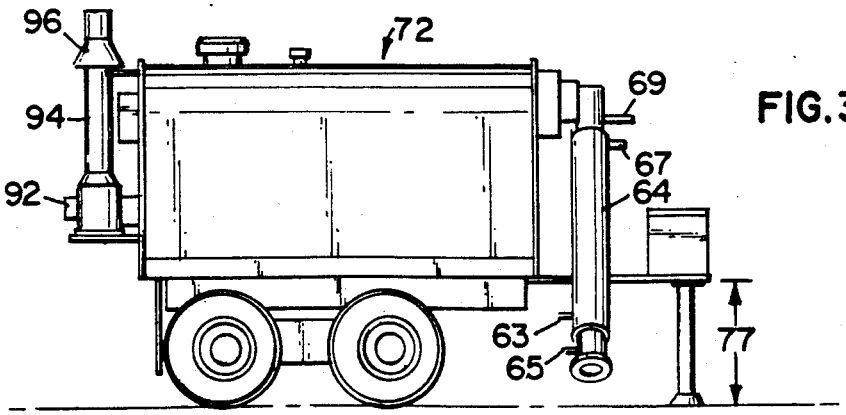
FIG. 3 is a side view depicting the condensing system and exhaust system in accordance with one embodiment of the present invention.

As a separate unit of the remediation apparatus, there is positioned adjacent the combustion chamber 12 a condensing system 62, FIGS. 1 and 3. The condensing system generally includes a condensing unit 72 which is fed exhaust gas by a conduit 64. The conduit 64 provides communication between the rear end 16 of the combustion chamber 12 and condensing unit 72, FIG. 1. As can be seen in FIGS. 3, 6 and 7, the conduit may comprise a precooling mechanism having an outer water circulating jacket 66 and an inner cooling manifold 68 which are fed by respective inlets 63, 65 and outlets 67 and 69.

The condensing unit 72 comprises two chambers, FIG. 6. The first chamber 74 of the condensing unit 72 is a water tight housing encasing a number of condensing tubes 78. The second chamber 76 of the condensing unit 62 is used to collect condensate as the condensing tubes 84 vent into the second chamber 76.

The condensed cleaned exhaust vents from an outlet or opening 82 in the rear of the second chamber 76. A fan is positioned adjacent the opening 82 in the second condensing unit chamber 76. An exhaust stack may be affixed on top of the fan 92 having a profile plate burner 96 affixed at the top of the exhaust stack 92 and a plate 98 positioned within the stack, FIG. 6.

In its most preferred embodiment, the present invention may be transported by wheeled vehicular trailers. In operation, the apparatus of the present invention may be set up in less than one hour and may take up a total space on site ranging from about 1000 sq ft to 3000 sq ft.

Combustion Chamber

The combustion chamber functions to house the flame burners and the mill. In operation, the combustion chamber provides a closed environment for the aeration and suspension of the contaminated fill by a mill and the thermal remediation of the fill by combusting the contaminates within the fill as the fill is suspended by the paddles on the mill shafts.

Generally, the combustion chamber may take any size or shape which will support the flame burners and the mill. The size and shape of the combustion chamber should also allow the burner flames to be focused on the intended portion of the chamber. As can be seen, one embodiment of the combustion chamber 12 preferably has an elongated generally cylindrical shape which may house any number of mill shafts 22 and any number of flame burners 26, FIGS. 2 and 4. The combustion chamber preferably also may have a removable top 15 allowing easy access to the combustion area, FIG. 5. Generally, the top 15 of the combustion chamber 12 may be fitted to allow for expansion and contraction of the chamber during heating and cooling and may be held in place by bolts and flanges which follow the contour of the angled side wall 13 of the combustion chamber.

Figure 5:
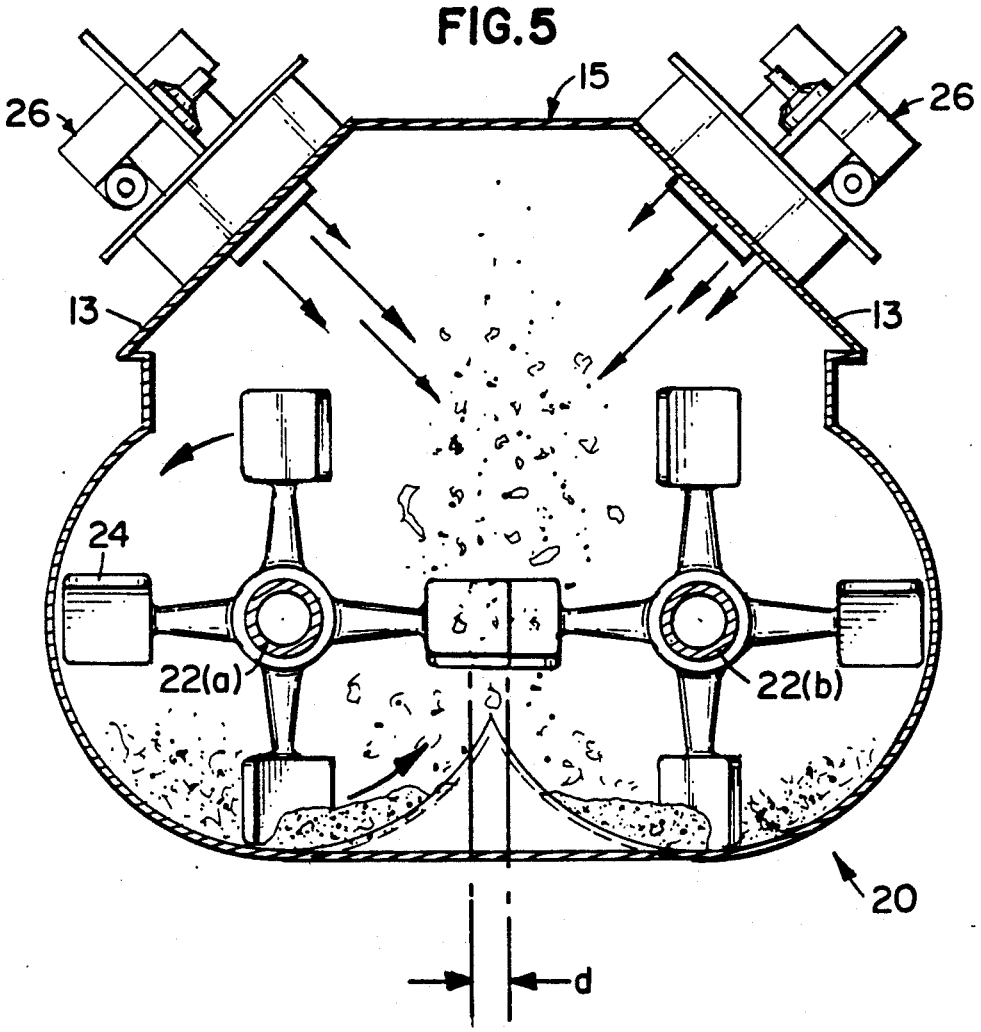
FIG. 5 is a cross-sectional view taken along lines 5—5 of the combustion chamber of the present invention shown in FIG. 4.

The combustion chamber 12 comprises one or more flame burners 26, FIGS. 4 and 5. The function of these burners is to combust the elements which have contaminated the fill. Generally, burners which are useful in the apparatus of the present invention are those which project a flame towards the area of the chamber in which suspended fill is concentrated, FIG. 5.

More specifically, as can be seen in FIG. 5, the burners are configured on the sloped sides 13 of the combustion chamber 12 and positioned at an angle which directs flame towards the area of principal concentration of the suspended contaminated fill. In this instance, the burner flame is preferably fan projected so that a definite air flow pattern is established in that area of the chamber.

The burners 26 are positioned on the side 13 of the combustion chamber 12 at an angle which ranges from about 20° to about 70° so that the flame is directed across the top of the path of the mixing paddles 24 and towards the principal area of concentration of suspended contaminated fill within the chamber, FIG. 5.

In this manner, the direction and concentration of the air flow ensures a maximum burner combustion temperature and combines oxygen, flame, and the combustion fuel—the contaminants in the fill—in one common area throughout the chamber 12.

Furthermore, the use of an air flow which is directed immediately at the greatest concentration of suspended fill provides for a maximum combustion with a minimal amount of air flow. Generally, the air flow through the chamber 12 and condenser ranges from about 900 cubic feet per minute to about 1300 cubic feet per minute and preferably about 1100 cubic feet per minute. As a result, use of the apparatus of the present invention does not produce an extended volume of air which must be cleaned of particulates and other contaminants through condensing or other means.

In accordance with another preferred aspect of the present invention, the burners 26 are positioned over the length of the combustion chamber 12, FIG. 4, to provide an active combustion flame along the length of the mill 20. Specifically, FIGS. 4 and 5, the burners 26 alternate between the opposite angled sides 13 of the combustion chamber 12 in order to provide maximum exposure to the suspended contaminated fill during processing.

The burners used in the present invention are preferably thermocoupled to provide a maximum temperature of 2200° F. with a preferred operating temperature of 1500° F. Generally, burners useful in the present invention are those which provide 50 to 800,000 BTU's/minute given a standard propane fuel base. The burners are also preferably fan blown to provide a definite flame direction and intensity in that area of the combustion chamber 12 where the suspended fill will be most prevalent, FIG. 5.

Burners which have been found useful in the present invention include Incinomite Brand burners from Midco International, Incorporated, such as Model J83DS which run on either natural or propane gas. Generally, the burners are operated on a propane fuel at a temperature which may range from 800°-1500° F. and preferably is between 900°-1100° F., and most preferably about 1000° F. Generally, the burners are operated at a temperature which may range from 800°-1500° F. and preferably is between 900°-1100° F., and most preferably about 1000° F. At these temperatures the burners are preferably providing about 400,000 BTU's/min.

The combustion chamber also comprises a mill 20, having at least one shaft 22 with a plurality of mixing paddles 24 affixed thereto, FIG. 4. The shaft 22 turns upward thereby projecting the fill into the path of the burner flame so that the contaminants may be combusted. By suspending the fill within the combustion chamber 12 the mill separates and aerates the contaminated fill exposing a greater amount of the particulate surface area of individual fill particles to the burner flame. This action also incorporates more oxygen into the fill.

In this manner, an efficient and complete burn of contaminants results from a combination of the suspending action of the mill and the fan focused flame providing a high concentration of flame, oxygen, and fuel in one central area. The mixing paddles on the mill shaft 22 also mechanically move the fill through the combustion chamber 12 and eventually to the discharge hopper 52 at the rear of the apparatus.

Generally, the mills comprise shafts 22 having a plurality of mixing paddles 24 affixed thereon, FIG. 4. The shaft 22 may be of any given length having any number of mixing paddles 24 positioned thereon. The shafts may generally be the length of the combustion chamber 12 to pass the fill through the chamber and exposing the fill to the series of burners 26 in the chamber 12. Generally, the shaft 22 traverses the length of the mill being attached between the gear box 23 at the combustion chamber front end 14 and support plate 25 at the rear end 16 of the combustion chamber, FIG. 4. Additionally, the mixing paddles 24 positioned on the mill shaft 22 may be positioned at regular intervals along the length of the rod to provide a constant suspending action and to minimize dead space within the chamber, FIG. 4. Generally, the paddles 24 may also be angled to provide a continued action which moves the fill towards the discharge hopper 52 at the rear 16 of the chamber 12. The angle of the paddles 24 may also be varied to vary the retention time of the fill within the chamber.

In accordance with one embodiment of the present invention, FIG. 5, the combustion chamber 12 comprises a mill 20 having at least two shafts **22*a* and 22*b*. The shafts are spaced to allow an overlap between the mixing paddles 24. The overlap (d) between the mixing paddles 24, FIG. 5 allows for efficient movement of the fill throughout the combustion chamber 12 without contacting the oppositely extending paddles. Along with this overlap, the movement of the mill shafts, 22*a* and 22*b*, are synchronized in opposite directions with the shafts moving upwards as they move together, (note arrows). This mill action directs the fill towards the center of the combustion chamber 12** and then upward into the path of the burner flame. Accordingly, the suspended particulate fill receives maximum exposure to the burner flame.

In operation, the mills generally turn at a speed which ranges from about 200 rpm to 800 rpm, preferably 250 to 600 rpm and most preferably from about 250 rpm to 400 rpm. The effect of the mixing paddles 24 in combination with the burner flame is to direct the flame after the course of the mixing paddles in a rolling action which follows the rotation of the paddles around each shaft. Thus, the apparatus of the present invention provides for a maximum combustion of the contaminants in those particulates which are suspended within the volume of the combustion chamber 12. Moreover, the air blown flame as well as the mixing paddles provide for combusting hydrocarbon contaminants within the particulates which may temporarily be residing at the floor of the combustion chamber or within the circumference of the paddle rotation.

The combustion chamber also comprises a control mechanism which is preferably focused around a control center 25 and main power box 29, FIG. 2. The function of the control mechanism is to provide a system for controlling any means used to load the contaminated fill into the combustion chamber, run the mill shafts, as well as fire, monitor and control the burners, and controlling the fan. Moreover, the control mechanism may be used to purge the discharge hatch, monitor the temperature of exhaust throughout the machine and monitor the water temperature used in the condensing system. The control mechanisms of the present invention are preferably operated from a central position 25 at the front of the apparatus and allow selective use of the mill and burners apart from the loading mechanisms.

In view of these functions, the control mechanism may be any variety of mechanical, electromechanical, hand wired electrical circuitry or solid state microprocessing mechanism or apparatus known to those of skill in the art. In accordance with one embodiment of the present invention the control mechanism comprises a main electrical motor 39 used to run the mills 20 within the combustion chamber 12, FIG. 2. This motor may generally be driven by an electrical generator 37. Generally useful in the present invention is a 100 kilowatt KATO brand generator used to run a 75 hp motor. In turn, the motor is engaged by a manual clutch between the motor and the mill and the motor and the loading means.

The burners may be controlled and monitored through any variety of electrical means but preferably allow electrical temperature control and are thermocoupled so that the temperature of each burner may be individually monitored. In turn, the burners and thermocouples may be connected to any variety of electrical or solid state, programmable or nonprogrammable monitors which enable active monitoring of the burner temperature.

In one embodiment of the present invention the thermocouples and burners are preferably connected to programmable solid state control devices such as the Universal Digital Controllers made by Honeywell such as the UDC 2000 Minipro. These controllers allow for the monitoring of the burner between varying temperatures while having an absolute temperature maximum at which time burner shutdown would be initiated. The plate burner 96 on the exhaust stack 94, FIG. 6, may also be monitored by the same burner control - thermocouple solid state control system. Thermocouples useful in the present invention include those manufactured by Gordon Temperature Measurement Incorporated.

Those thermocouples which have been found particularly useful in the present invention include K-type thermocouples rated up to 2282° F. positioned opposite the combustion chamber burners 26 and adJacent the exhaust port 27. Also preferred are J-type thermocouples rated up to 1382° F. positioned at the precooling conduit, at the plate burner 96, at the exhaust fan, at the inlet and midpoints within the condensing system as well as the draw off port 90 for condensate among a variety of other temperature critical locations which may require monitoring to ensure an efficient nonpolluting burn of contaminants. Thermocouples may also be placed at various other temperature critical areas in the present apparatus.

Accordingly, as can be seen, any type of electrical control mechanism may be used which will provide adequate feedback to the control center 25. Such a control center preferably allows one man to control the primary functions of the apparatus of the present invention from a single location.

In operation, the generator is started to provide 440 volts to the main power box 29. The main power box in turn transforms the 440 volts to 220 volts and 110 volts. The 110 volt feed is used to initiate the burners as well as the burner fan motors. This voltage additionally functions to integrate the burners control with the thermocouple digital temperature control system previously disclosed.

The 110 volt feed transformed by the main power box additionally functions to initiate the motor which runs the shafts within the mill. Specifically, in a preferred mode of the present invention, the 110 voltage charge is used to electromagnetically activate a cellunoid which engages the two stage motor that runs the mill shafts. The use of a two stage starter motor allows the use of a smaller generator and further facilitates the portability of the present invention. One motor which has been found useful in the present invention is 75 hp 60 cycle, 3 phase, 440 volt induction motor which is rated at 1650 rpm and manufactured by Fairbanks Morris Company. Once the motor is fully started the mill shafts may be clutch engaged to power a series of chains which in turn drive the gear box 23 to rotate the shafts 22*a* and 22*b*.

Finally, the transformed 220 volt charge is used to control the fan 92 which is positioned adjacent the outlet 82 at the condenser.

The present invention may also comprise mechanisms for loading the contaminated fill into the combustion chamber. Generally, loading mechanisms of any variety, size or type may be used in accordance with the present invention. Mechanisms such as bucket elevators, plate feed belts, and hoppers along with any variety of other elements have been found useful in efficiently loading the contaminated fill into the combustion chamber 12.

One embodiment of the present invention, FIG. 4, preferably uses a combination of a feed hopper 38, plate belt 36, and bucket elevator 32 to load the contaminated fill into the combustion chamber. In this instance, the hopper 38 has an open bottom and is located over the plate belt 36. The plate belt 36 runs in a direction which will gradually facilitate the unloading of the fill from the hopper, with the fill moving towards the bucket elevator 32. At the junction 31 between the plate belt 36 and the bucket elevator 32 the fill is dumped into the individual buckets 34 on the elevator. The bucket elevator 32 then travels upwards to a peak 33 at which point the buckets 34 invert, dumping the fill into the inlet hatch 11 at the first end 16 of the combustion chamber 12.

As with the mills, the loading mechanism may be run from the same motor and clutch system. However, it is preferred to run the loading mechanism from the main motor using a separate clutch system. Use of a separate clutch system allows the loading mechanism to be disengaged while the combustion chamber is cleared of any remaining remediated fill.

Additionally, the apparatus of the present invention may also comprise an aqueous spray bar 40, FIG. 4. The spray bar functions to provide a dampening aqueous mist to the contaminated fill prior to the loading of the fill into the combustion chamber. The dampening of the fill reduces the airborne dust around the general area in which the apparatus is used.

Generally, the spray bar may take any number of forms. However, one embodiment which has been found to be especially useful is a cylindrical bar spanning a width of the feed plate belt 36, having a number of ports directed vertically downward towards the plate belt which spray an aqueous mist onto the fill as it moves down the belt. In one embodiment of the invention, FIG. 4, the spray bar 40 is preferably positioned across the width of the feed belt 36 approximately midway along the feed plate belt between the outer edge of the hopper 38 and the end of the belt 31.

The apparatus of the present invention may also comprise a feeder plate 41, FIG. 4. The feeder plate functions to vary and control the amount of fill which is introduced into the bucket elevators. Generally, the feeder plate may simply be a bar suspended above belt 36 and spanning the width of belt 36. The feeder plate 41 may be held in a slotted configuration and manually raised and lowered to increase or decrease, respectively, the amount of fill which is allowed to flow over the face of the plate belt into the bucket elevator.

Once the remediation process has been completed, the decontaminated fill is placed in some type of discharge hopper 52, FIG. 4, and the exhaust gas resulting from the process is released into the condenser 62 through a vent or exhaust gas outlet 27 into conduit 64.

Considering the fill first, in accordance with one preferred aspect of present invention the mechanical action of the mixing paddles 24 pushes the fill from the combustion chamber 12 out into a discharge hopper 52, FIG. 4. The discharge hopper 52 may then be used to contain the fill until it can be monitored to ensure complete combustion of all chemical hydrocarbon contaminants. Once confirmed clean, the discharge hopper 52 may be opened and the fill discharged, FIG. 1. Accordingly, soil may be treated on site, removed from the ground, transferred into the hopper, processed through the combustion chamber to the discharge hopper 52 and then immediately placed back into the ground from which it was excavated.

Generally, any variety of sealing mechanisms may be used to close the hopper 52 including clam shell-type doors 54 as shown in FIG. 2. In this instance, the clam shell doors 54 are controlled by a compressed air system 35 operated through the air compressor 35, FIG. 2, located at the front of the apparatus. In the present invention, air compressors ranging in size from 3 hp to about 10 hp and preferably 5 hp having a compression of 18 cubic feet per minute at 165 psi having been found especially useful.

An additional means of preparing the contaminated fill for processing in accordance with the present invention is by prescreening the fill. For example, the fill may be placed through a vibrating screen which allows a 1 inch particle size to pass through each respective screen opening. The use of prescreening mechanisms to process the fill will generally increase the area of operation, but, still maintain this area within 3000 square feet.

In operation, in order to facilitate increased particle definition, the screen may vibrate and additionally may be used in conjunction with a system for injecting air into the clumps. Air may be injected through the air compressor located at the front of the system. This prescreening process which will additionally function to increase the surface area of each respective particle as well as increasing the concentration of oxygen within the fill in order to facilitate combustion.

Condensing System

The next element of the present invention is a condensing system. The condensing system functions to cool exhaust gas, a well as to remove particulate and hydrocarbon pollutants which may result from the combustion processes of the present invention.

Generally, the condensing system of the present invention may comprise any devices which function in the particulate and gaseous pollutant removal processes detailed above. In accordance with one embodiment of the present invention, there is shown in FIG. 3 a condensing system comprising a conduit 64 disconnected from the combustion chamber 12.

The conduit 64, vents the exhaust from the combustion chamber 12 into condensing unit 72. Moreover, the conduit 64 may provide additional cooling action to the condensing system and condense particulate and gaseous contaminants which result from the combustion chamber processes.

In accordance with one preferred aspect of the present invention the conduit is an inner/outer jacketed precooling unit, FIGS. 6 through 8. As can be seen, this "precooling" conduit 64 has an outer water jacket 66 and an interior water cooled manifold, 68, FIG. 8. The water cooled jacket 66 and manifold 68 are fed by two inlet ports 63, 65, respectively, on the side of the precooling conduit 64. Once circulated through the water jacket 66 and manifold 68, the water is vented from the system through exit ports 67 and 69, FIG. 6. The manifold 68 is held within the conduit 64 by supports 61.

The water used in the precooling conduit 64 does not contact the exhaust fumes and thus is not degraded or contaminated by the present system. Accordingly, any water source may be used with the water ultimately being returned into the local storm sewer. In operation, the precooling conduit is capable of dropping the exhaust temperature 40% between the combustion chamber and the condensing chamber. Generally, the precooling conduit is run with water circulating at a rate of 10–15 gallons per minute between the jacket and manifold at a temperature ranging from 40° F. to 90° F.

While not shown, the precooling conduit may be connected and detached from the combustion chamber 12 by use of a hydraulic lift which may be conveniently placed on the side of the condensing unit 72 adjacent the entry port 73 to the unit 72.

The second element of the condensing system is the condensing unit 72, FIG. 6. The condensing unit further cools the exhaust, condenses particulates and hydrocarbon contaminants within the exhaust, and generally reduces the dust and smoke resulting from the process.

Here again, any general condensing process or apparatus may be used. However, one embodiment of the condensing unit is depicted in FIGS. 3 and 6. In this instance, the condensing unit 72 generally comprises two compartments. The first compartment 74 is preferably a water tight volume containing a plurality of condensing tubes 78, 78' which run the length of compartment 74. Water may be flowed through this volume by an inlet/outlet system to continually cool tubes 78, 78' and further condense the exhaust.

The condensing tubes 78, 78' may be joined to the precooling conduit through port 73 found at the inlet 75 to the condensing chamber. These tubes then run the length of the chamber 74 to a draw off box 79 which passes the exhaust to a second set of condensing tubes 78' which are angled slightly upward to drain the condensate back into the draw off box 79. The exhaust exits the second set of condensing tubes 78' into the second chamber 76 within the condensing unit 72. The draw off box 79 may be drained through an outlet pipe 90 which leads to port 90. The draw off box 79 may also be removed to remove particulate build up within the condensing system.

The exhaust as well as any condensate enter the second chamber 76 which is surrounded or saddled by the jacketing sides of the first chamber 74, FIG. 7. The exhaust is then pulled from the second condensing chamber 76 through opening 82 into the exhaust stack 94 by a fan 92 at the base of the second chamber 76. The second chamber also has a hatch 71 which may be used for cleaning or repair of the condensing unit 72. The condensate may be drawn from the condensing unit 72 at the port 90 on back end of the unit.

In operation, exhaust enters the first chamber 74 of the condensing unit 72 traveling through the condensing pipes 78. The exhaust is cooled and particulates condensed by water flowing through the chamber 74 at a rate which may range from 5 to 20 gallons/minute placing a pressure between 20 and 80 lbs/in$^2$ on the system. The condensing unit 72 is thermocoupled at various critical areas. Accordingly, the temperature and pressure of the water throughout the chamber may be monitored and varied to suit any number of conditions. The condensing unit of the present invention may be able to effectively reduce the exhaust temperature as much as 10° below the ambient environmental temperature.

Exhaust System

An additional element of the apparatus of the present invention is the exhaust system. The exhaust system functions to pull gases throughout the thermal remediation apparatus and vent the exhaust. The exhaust system generally comprises a fan 92, which is affixed to an outlet 82 at the base of the condensing unit 72, FIG. 6. The exhaust system may be additionally supplemented by an exhaust stack 94 which may be affixed to the fan 92. Finally, the exhaust system may also comprise a profile plate burner 96.

The principal element of the exhaust system is a fan 92 which functions to pull gases throughout the entire thermal remediation apparatus. Removing gases from the combustion chamber 12 avoids gas build up and the potential for explosion. The fan also facilitates condensation of particulates by drawing the exhaust through the precooling conduit 64 and into the condensing unit 72. Finally, the fan 92 vents the cleaned exhaust into the environment.

The fan also preferably creates a negative pressure which maintains complete combustion of contaminants without producing large volumes of exhaust gas. Generally, any variety of fan mechanisms may be used in the apparatus of the present invention having the strength to ensure removal of exhaust from the system. One fan which has been found useful in the present invention is a Model 2C864 manufactured by Dayton having 10 inch blades turning at about 1600 rpm to 1800 rpm and capable of pulling a air flow ranging from about 900 cfm to 1300 cfm and preferably about 1100 cfm.

The exhaust system used in the apparatus of the present invention may also comprise an exhaust stack 94 and plate burner 96 positioned in any variety of manners in relationship to the fan 92 and exit port 82 from the condensing unit second chamber. Generally, the exhaust stack 94 functions to carry the cleaned exhaust up and away from the working area and support the profile plate burner. Accordingly, the exhaust stack may comprise any variety of forms having any variety of lengths.

As can be seen in FIG. 6, in one embodiment of the apparatus of the present invention an exhaust stack is affixed atop the fan 92, adjacent the rear of the condensing unit 72. Affixed at the top of the exhaust stack is a plate burner which may also be used in the exhaust system of the present invention. The plate burner functions to ensure complete combustion of any contaminants remaining in the condensed exhaust.

Specifically, the plate burner comprises a burner 96 which projects a flame onto a plate 98, the plate filling the circumferential area of the exhaust stack 94, FIG. 6. The plate is held in the stack 94 by any number of supports 97 and generally comprises a number of holes 99 which allow gas flow out of the exhaust stack 94, FIG. 9.

In operation, the burner 96 heats the plate 98 and the heated plate 99 slows the flow of exhaust from the stack additionally combusts any combustible contaminants left in the exhaust prior to venting to the atmosphere. The effective temperature of the burner 96 may be monitored by a thermocouple 100 mounted adjacent the plate and read at the control center 25, FIG. 9.

A plate burner is preferred during start up and shut down operations when the combustion chamber may not be working at maximum efficiency. The plate burner in these instances functions to ensure complete combustion of any volatiles which may have escaped the combustion chamber and not have been condensed within the condensing unit.

Here again, the burner used as a plate burner in the present invention are preferably thermocoupled to provide a maximum temperature of 2100° F. with a preferred operating temperature ranging from about 400° F. to 800° F., and most preferably 650° F. Generally burners useful in the present invention are those which provide 50°–800,000 BTU's/min. given a standard propane fuel base. The burners are also preferably fan blown to provide a definite flame direction and intensity onto the plate. Burners which have been found useful in the present invention include Incinomite Brand burners from Midco International, Inc. such as Model J83DS which runs on either natural or propane gas.

The above discussion, examples, embodiments, and

Operation

In operation, contaminated fill is introduced into a hopper 38, FIG. 4. The fill is then drawn off by a plate belt 36 towards a bucket elevator 32. The amount of fill emptied into the bucket elevator from the plate belt may be monitored by a feeder plate 41 which can be used to control the amount of fill moving across the plate belt 36 at any given time.

The fill may be sprayed as it moves across the plate belt 36 by spray bar 40. The dampening of the fill has been found to be an important factor in the efficient combustion of hydrocarbon contaminates while minimizing the amount of particulate pollutants generated by the combustion process. Specifically, the addition of moisture to the fill reduces the dust generated during the loading of the combustion chamber. Moreover, increasing the level of moisture in the fill counteracts the adverse effects of the suspending process which takes place in the combustion chamber. Specifically, while increasing combustion, the present suspension process may effectively increase the particulates within the exhaust vented from the combustion chamber.

The addition of moisture to the fill prior to introducing the fill to the combustion chamber provides a steam constituent to the exhaust which exits through vent 27 once the combustion process is completed. This steam functions to provide an additional element which further clears the particulates from the gas exhaust. Moreover, the steam additionally functions to clear the condensing pipes 78, 78', FIG. 6.

As a general guideline, the volume of water added to the fill will vary depending upon the level of contaminants in the fill as well as the level of moisture within the fill prior to processing. In one preferred embodiment the spray bar is capable of dispensing as much as 20 gallons per minute. However, this volume of water may be excessive and often times no water may be required.

However, these guidelines will vary tremendously from one operation to the next depending on any number of factors. Preferably, the concentration of moisture within the fill will be such that the amount of particulate exhaust visible from the exhaust stack will be minimal while the concentration of contaminants in the file will be reduced to the intended level.

From the plate belt and bucket elevator 32, the fill is introduced into the combustion chamber at the inlet port 11. The fill is then moved through the combustion chamber 12 by the shaft mixing paddles 24 which act to suspend the particulate fill within the chamber 12 as well as move the fill from the front end 16 of the chamber towards the discharge hopper 52 at the rear end 14 of the chamber.

In operation, the rate at which the fill will be processed through the combustion chamber will vary depending again upon the moisture content of the fill as well as the concentration of contaminants within the fill. The rate at which the fill may be processed may also vary depending upon the particle size of the fill being processed at any given time. For example, the processing time for fill having a relative concentration of 50 wt-% contaminants will be much greater for a separate sample of fill having only 10% contaminants.

As a general guideline, the rate at which fill can be processed will range from about 0.1 cubic yard per minute to about 1 cubic yard per minute, preferably from about 0.25 cubic yard per minute to about 0.75 cubic yard per minute, and most preferably from about 0.45 cubic yard per minute to about 0.55 cubic yard per minute.

Here again, those skilled in the art will appreciate the fact that the preceding is merely a guideline and that actual processing times may vary greatly depending upon the type of fill that is to be processed, the use of prescreening methods, the use of additional burners, the use of an extended combustion chamber or the number of mixing paddles and any number of other factors including the retention time within the combustion chamber.

Once the remediated fill is released from the combustion chamber into the discharge hopper, the exhaust traverses into vent 27 into the precooling conduit 64. The precooling conduit may be affixed to the combustion chamber through any number of means known to those with skill in the art. Preferably, the precooling conduit 64 is affixed to the combustion chamber 12 through a joint system which allows the conduit to be angled in relation to the condensing unit 72 and combustion chamber 12. Specifically, a slip joint system may be used to maintain a tight seal at the conduit/chamber interface and the conduit/condensing unit interface.

Preferably, the precooling condenser is also angled upward 10° to 15° from the combustion chamber 12 to the condensing unit 72. This angling may be completed through any number of operations including decreasing the distance (x) at the front end of the combustion chamber, FIG. 4.

The distance (y), FIG. 6 at the front end of the condensing unit 72 may be increased to increase the angle of the precooling conduit and the condenser. Adjusting the angle of the condensing unit 72 backward 10° to 15° assists the condensing tubes within the condensing unit from becoming clogged. The exhaust gas once it travels the initial length of the condensing tube 78 traverses through draw off box 79 into the second set of o condensing tubes 78', FIG. 6. The collected condensate from each set of condensing tubes is allowed to settle into the box 79 which may be emptied through draw off 91 and port 90. Condensate is collected effectively from each set of condensing tubes while the exhaust continues to traverse the tubes and enters into the second chamber 76 of the condensing unit. The exhaust is then pulled from the condensing unit through fan 92 and vented into the exhaust stack 94.

Once in the exhaust stack 94, the exhaust then encounters the plate burner 96, FIG. 6. The configuration of the plate 98 of this burner, FIG. 9, prevents the exhaust from exiting the stack 94 without being largely or wholly contacted with the plate. The plate 98 is contacted by the flame from the burner 96 which heats the system to additionally combust any volatiles remaining within the exhaust gas. The supported plate obstructs the exhaust stack while providing clearance through the circumferential area between the outer edge of the plate and the inner edge of the exhaust stack as well as the individual holes 99. The plate functions to slow the flow of exhaust from the stack ensuring the heating and combustion of any volatiles which may additionally be obtained within the stack. As a result, if the system is adjusted in accordance with one preferred embodiment of the present invention the exhaust resulting from the stack should comprise principally cleaned exhaust with the majority of particulates being collected in the second chamber 76 and the draw off box 79 within the condenser 72.

The above discussion, examples, and data illustrate our current understanding of the invention. However, since many variations of the invention can be made without departing from the spirit and scope of the invention, the invention resides wholly in the claims herein after appended.

I claim as my invention:

1. A thermal remediation apparatus for the combustion of hydrocarbon contaminants within particulate fill, said apparatus comprising:

(a) a chamber having an inlet, an outlet, an exhaust port, means for combusting the fill contaminants within the chamber, and paddle means for agitating the fill into an air suspension in the path of said combusting means, said combusting means comprising at least one burner and said agitating paddle means comprising a mill;

(b) a condenser having an inlet and an outlet, said condenser inlet in communication with the exhaust port of said combustion chamber; and (c) a fan affixed adjacent said condenser outlet.

2. A thermal remediation apparatus for the combustion of hydrocarbon contaminants within particulate fill, said apparatus comprising:

a chamber comprising an inlet for loading contaminated fill into said chamber, an outlet for the discharge of remediated fill, an exhaust port, means for combusting the fill contaminants within the chamber and paddle means for agitating the fill into an air suspension in the path of said combusting means, said combusting means comprising at least one burner and said agitating paddle means comprising a mill, said mill having at least one shaft with a plurality of mixing paddles thereon, said mill adapted to agitate the fill into an air suspension within the chamber, and to move the fill from said inlet to said outlet, said burner positioned to direct flame over the upper surface of said mill shaft within said combustion chamber;

(b) a condenser having an inlet and an outlet, said condenser inlet in communication with the exhaust port of said combustion chamber; and (c) a fan affixed adjacent said condenser outlet.

3. The apparatus of claim 2 wherein said chamber and said condenser are portable and capable of being transported by a wheeled vehicle.

4. The apparatus of claim 2, wherein said combustion chamber is shaped generally cylindrically and comprises a plurality of burners and a plurality of shafts within said mill.

5. The apparatus of claim 2, wherein said combustion chamber comprises four burners and a mill, said mill comprising two shafts, each of said shafts having a plurality of mixing paddles positioned thereon, said shafts transversing the length of the chamber from said inlet to said outlet, said burners positioned on the exterior of the combustion chamber, said burners oriented to project flame around the center of each shaft.

6. The apparatus of claim 5 wherein said mill shafts rotate in opposite directions, rotating upward as they turn towards each other.

7. The apparatus of claim 2 additionally comprising means for loading fill, said loading means positioned adjacent said combustion chamber inlet.

8. The apparatus of claim 7, wherein said loading means comprises a hopper.

9. The apparatus of claim 7, wherein said loading means comprises a feed belt and hopper, said feed belt positioned adjacent said combustion chamber inlet and said hopper positioned over said feed belt.

10. The apparatus of claim 8, wherein said loading means comprises a bucket elevator, feed belt, hopper and feeder plate, said bucket elevator having an upper end and a lower end, said bucket elevator upper end positioned adjacent said combustion chamber inlet, said feed belt positioned over the lower end of said bucket elevator, and said hopper positioned over said feed belt, and said feeder plate positioned over said feed belt and adjacent said hopper.

11. The apparatus of claim 10 additionally comprising a spray bar positioned above said feed belt and adjacent said hopper, said spray bar comprising a plurality of spray ports over the length of the bar.

12. The apparatus of claim 2 additionally comprising a discharge hopper positioned at said combustion chamber outlet.

13. The apparatus of claim 12, wherein said discharge hopper is sealed by air controlled doors.

14. The apparatus of claim 2, wherein said condenser comprises a conduit and a condensing unit, said conduit connectably joining said combustion chamber exhaust port and said condenser inlet.

15. The apparatus of claim 14, wherein said conduit comprises a precooling conduit having an outer water cooled jacket and an inner water cooled manifold.

16. The apparatus of claim 14, wherein said condensing unit comprises a two chamber structure, said first chamber comprising a water tight housing encasing a plurality of condensing tubes, said second condensing unit chamber comprising a housing for tubes collecting condensate, said condensing tubes venting into said second chamber.

17. The apparatus of claim 14 wherein said condensing unit comprises condensing tubes ranging in size from about 1½ inches to about 3 inches.

18. The apparatus of claim 3 additionally comprising an exhaust stack affixed to said fan.

19. The apparatus of claim 18 additionally comprising a plate burner affixed to said exhaust stack.

20. A thermal remediation apparatus for the combustion of hydrocarbon contaminants within particulate matter, said apparatus comprising:

(a) a combustion chamber comprising an exhaust port, an inlet hatch for loading contaminated fill into the chamber, and an outlet hatch for the discharge of remediated fill from the chamber, said chamber comprising at least one burner and a mill, said mill having at least one shaft with a plurality of mixing paddles positioned thereon, said mill adapted to agitate the fill into an air suspension within the chamber and to move the fill from the inlet to the outlet of the chamber, said burner positioned to direct flame over the upper surface of said mill shaft within said combustion chamber;

(b) a condenser affixed to said combustion chamber said condenser comprising a condensing unit and conduit, said condensing unit having an inlet port and an outlet port, said conduit being in communication between said combustion chamber exhaust port and said condensing unit inlet port;

(c) means for loading fill positioned adjacent said combustion chamber inlet hatch; and (d) a fan affixed adjacent said condensing unit outlet port.

21. The apparatus of claim 20 wherein said condenser circuit comprises a precooling conduit having an outer water cooled jacket and an inner water cooled manifold.

22. The apparatus of claim 20 wherein said thermal remediation apparatus is portable and capable of being transported by a wheeled vehicle.

23. The apparatus of claim 20 wherein said loading means comprises a bucket elevator, feed belt, hopper, and feeder plate, said bucket elevator having an upper end and a lower end positioned adjacent said combustion chamber inlet, said feed belt positioned over the lower end of said bucket elevator, said hopper positioned over said feed belt, and said feeder plate positioned over said feed belt and adjacent said hopper.

24. The apparatus of claim 23 additionally comprising a spray bar positioned over the width of said feed belt.

25. The apparatus of claim 20 wherein said combustion chamber comprises four burners and a mill having two shafts, each of said shafts having a plurality of paddles positioned thereon, said mill shafts traversing the length of the chamber from said chamber inlet to said chamber outlet, said burners positioned on the exterior of the combustion chamber to direct flame at the upper region of the shaft and around the shaft.

26. The apparatus of claim 25 wherein said shafts rotate in opposite directions, rotating upward as they turn towards each other.

27. The apparatus of claim 20 wherein said condensing unit comprises a two chamber structure, said first chamber comprising a water tight housing encasing a plurality of condensing tubes, said second condensing unit chamber comprising a housing for collecting condensate, said condensing tubes venting into said second chamber.

28. The apparatus of claim 27 wherein said condensing tubes range in size from about 1½ inches to 3 inches.

29. A thermal remediation apparatus for the combustion of hydrocarbon contaminants within particulate matter, said apparatus comprising:

(a) a generally cylindrical combustion chamber having an exhaust port, an inlet and an outlet, said combustion chamber further comprising:

(i) a mill comprising two shafts traversing the length of said combustion chamber, each of said shafts having a plurality of mixing paddles positioned thereon, and (ii) four burners offset across the upper exterior surface of said combustion chamber, said burners positioned to direct flame towards the mixing paddles positioned on said shafts and said burners oriented generally to direct flame around the circumference of each of said mill shafts within the chamber, said mill adapted to agitate the fill into an air suspension within the chamber and to move the fill from the chamber inlet to the chamber outlet;

(b) means for loading contaminated fill into said combustion chamber, said loading means comprising a bucket elevator, a feed belt, and a hopper, said bucket elevator having an upper end and a lower end, said bucket elevator upper end positioned adjacent said combustion chamber inlet, a feed belt positioned over the lower end of said bucket elevator and a hopper positioned over said feed belt;

(c) a spray bar positioned above said feed belt, said spray bar comprising a plurality of spray ports over the length of the bar;

(d) a discharge hopper adjacent said combustion chamber outlet;

(e) a condenser comprising a condensing unit and a conduit, said condensing unit comprising an inlet port, outlet port, and a first and second chamber, said first condensing unit chamber comprising a water tight housing encasing a plurality of condensing tubes, said second condensing unit chamber comprising a housing for collecting condensate, said condensing tubes venting into said second chamber, said second chamber venting from said condensing unit outlet, said condensing unit in communication with said combustion chamber through said conduit, said conduit affixed between said combustion chamber exhaust port and said condensing unit inlet port;

(f) a fan positioned adjacent the condensing unit outlet port;

(g) an exhaust stack affixed to said fan; and (h) a plate burner affixed to said exhaust stack.

30. The apparatus of claim 29 wherein said combustion chamber and said condenser are portable and capable of being transported by a wheeled vehicle.

31. The apparatus of claim 29 wherein said conduit comprises a precooling conduit having an outer water cooled jacket and an inner water cooled manifold.

32. The apparatus of claim 31 wherein said loading means hopper ranges in size from about 1 yard to about 10 yards.

33. The apparatus of claim 29 wherein said mill shafts rotate in opposite directions, rotating upward as they turn towards each other.

34. The apparatus of claim 29 wherein said discharge hopper additionally comprises air compressor controlled doors for dispensing of the decontaminated particulate matter.

35. A method for thermally removing hydrocarbon contaminants from particulate fill using a thermal remediation apparatus for the combustion of hydrocarbon contaminants within particulate fill, said apparatus comprising a combustion chamber having an exhaust port, an inlet hatch for loading contaminated fill and a discharge hatch for the discharge of remediated fill, said chamber comprising at least one burner and a mill, said mill having at least one shaft with a plurality of mixing paddles positioned thereon, said mill adapted to agitate the fill into an air suspension within the chamber and to move the fill from the inlet to the outlet of the chamber, said burner positioned to direct flame over the upper surface of said mill shaft within said combustion chamber, a condenser having an inlet port and an outlet port in communication with the exhaust port of said combustion chamber, and a fan affixed adjacent the condenser outlet, said method comprising the steps of:

(i) agitating the particulate fill into an air suspension in the path of the burner, (ii) heating the suspended contaminated fill with the burner flame thereby creating exhaust, and (iii) venting the exhaust to the condenser.

36. A method for thermally removing hydrocarbon contaminants from particulate fill using a thermal remediation apparatus for the combustion of hydrocarbon contaminants within particulate fill, said apparatus comprising a combustion chamber having an exhaust port, an inlet hatch for loading contaminated fill and a discharge hatch for the discharge of remediated fill, said chamber comprising at least one burner and a mill, said mill having at least two shafts with a plurality of mixing paddles positioned thereon, said mill adapted to agitate the fill into an air suspension within the chamber and to move the fill from the inlet to the outlet of the chamber, said burner positioned to direct flame over the upper surface of said mill shafts within said combustion chamber, a condenser having an inlet port and an outlet port in communication with the exhaust port of said combustion chamber, and a fan affixed adjacent the condenser outlet, said method comprising the steps of:

(i) agitating the particulate fill into an air suspension within the chamber by rotating said mill shafts in opposite directions, rotating upward as they turn towards each other, (ii) heating the suspended contaminated fill with the burner flame thereby creating exhaust, and (iii) venting the exhaust to the condenser.

37. The method of claim 36 wherein the burner flame temperature ranges from 800° F. to 1200° F.

38. The method of claim 36 wherein said contaminated fill is processed at a rate ranging from about 0.1 cubic yards/min to 2 cubic yards/min.

39. The method of claim 36 wherein the thermal remediation process is preceded by an additional step of applying a spray of water to said contaminated particulate matter.

40. The method of claim 36 wherein said thermal remediation apparatus additionally comprises an exhaust stack and an after burner, said exhaust stack affixed to said fan and said after burner affixed to said exhaust stack, said after burner burning the exhaust at a temperature ranging from about 500° F. to about 2200° F.

41. The method of claim 36 wherein said fan functions at a speed ranging from about 1500 rpm to about 1900 rpm pulling an air current ranging from about 900 cfm to about 1300 cfm.

* * * * *

UNITED STATES PATENT AND TRADEMARK OFFICE

CERTIFICATE OF CORRECTION

PATENT NO. : 5,020,452

DATED : June 4, 1991

INVENTOR(S) : David T. Rybak

It is certified that error appears in the above-identified patent and that said Letters Patent is hereby corrected as shown below:

In Column 16, line 16, "circuit" should read --conduit--.

In Column 17, line 54, delete "." after the word "hydrocarbon".

Signed and Sealed this

Eighth Day of December, 1992

*Attest:*

DOUGLAS B. COMER

*Attesting Officer*

*Acting Commissioner of Patents and Trademarks*